US007889044B2

(12) United States Patent
Ueda et al.

(10) Patent No.: US 7,889,044 B2
(45) Date of Patent: Feb. 15, 2011

(54) MULTILAYER COIL COMPONENT

(75) Inventors: Mitsuru Ueda, Shiga-ken (JP); Masaharu Konoue, Tokyo-to (JP); Hiroki Hashimoto, Shiga-ken (JP); Tatsuya Mizuno, Shiga-ken (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 12/778,694

(22) Filed: May 12, 2010

(65) Prior Publication Data

US 2010/0225437 A1 Sep. 9, 2010

Related U.S. Application Data

(63) Continuation of application No. PCT/JP2009/061458, filed on Jun. 24, 2009.

(30) Foreign Application Priority Data

Sep. 24, 2008 (JP) ..... 2008-243622

(51) Int. Cl.
*H01F 5/00* (2006.01)
*H01F 27/28* (2006.01)

(52) U.S. Cl. ..... 336/200; 336/223; 336/232

(58) Field of Classification Search ..... 336/200, 336/223, 232
See application file for complete search history.

(56) References Cited

U.S. PATENT DOCUMENTS 4,918,421 A * 4/1990 Lawless et al. ..... 338/21
5,239,744 A * 8/1993 Fleming et al. ..... 29/602.1
7,019,958 B2 * 3/2006 Togashi et al. ..... 361/303
7,719,399 B2 * 5/2010 Iwasaki ..... 336/200
2001/0017420 A1 8/2001 Iwao et al.

(Continued)

FOREIGN PATENT DOCUMENTS

JP 04-065807 3/1992

(Continued)

OTHER PUBLICATIONS

International Search Report PCT/JP2009/061458; Oct. 6, 2009.

(Continued)

*Primary Examiner*—Elvin G Enad
*Assistant Examiner*—Ronald W Hinson
(74) *Attorney, Agent, or Firm*—Studebaker & Brackett PC; Tim L. Brackett, Jr.

(57) ABSTRACT

A multilayer coil component is provided in which solder fusibility and a self-alignment property are prevented from being degraded due to absorption of a flux in a soldering step. The multilayer coil component has no voids present at interfaces between internal conductors 2 and a magnetic ceramic 11 located therearound. A magnetic ceramic forming a central region 7 has a region (side gap portion 8) which extends from a side surface 3*a* of the magnetic ceramic element to the internal conductors and which has a pore area ratio of 6% to 20%. At least one of a first external layer region 9*a*, located at an upper side of the central region, and a second external layer region 9*b*, located at a lower side of the central region (an external layer region at a mounting surface side of a mounting substrate), has a pore area ratio of less than 5%.

17 Claims, 6 Drawing Sheets

U.S. PATENT DOCUMENTS

2004/0084131 A1 5/2004 Konoue et al.

FOREIGN PATENT DOCUMENTS

| | | | |
|---|---|---|---|
| JP | 07-162265 | | 6/1995 |
| JP | 2000-164455 | A | 6/2000 |
| JP | 2001-244116 | A | 9/2001 |
| JP | 2002-064016 | A | 2/2002 |
| JP | 2004-022798 | A | 1/2004 |
| JP | 2004-079994 | A | 3/2004 |
| JP | 2005-044819 | A | 2/2005 |
| JP | 2005-286353 | A | 10/2005 |
| JP | 2008-066594 | A | 3/2008 |
| WO | 2009/034824 | A1 | 3/2009 |

OTHER PUBLICATIONS

K. Migita; Written Opinion of the International Searching Authority; PCT/JP2009/061458; Oct. 6, 2009.

* cited by examiner

MULTILAYER COIL COMPONENT

CROSS REFERENCE TO RELATED APPLICATIONS

The present application is a continuation of International Application No. PCT/JP2009/061458, filed Jun. 24, 2009, which claims priority to Japanese Patent Application No. 2008-243622 filed Sep. 24, 2008, the entire contents of each of these applications being incorporated herein by reference in their entirety.

BACKGROUND OF THE INVENTION

The present invention relates to a multilayer coil component having the structure in which a magnetic ceramic element includes a spiral coil therein, the magnetic ceramic element being formed by firing a ceramic laminate in which coil-forming internal conductors primarily composed of Ag and magnetic ceramic layers are laminated to each other.

DESCRIPTION OF THE RELATED ART

In recent years, electronic components have been increasingly required to be miniaturized, and also as for coil components, a multilayer type has been becoming a mainstream.

Incidentally, in a multilayer coil component obtained by simultaneous firing of a magnetic ceramic and internal conductors, internal stress generated by the difference in coefficient of thermal expansion between magnetic ceramic layers and internal conductor layers degrades magnetic characteristics of the magnetic ceramic and causes a problem in that the impedance value of the multilayer coil component decreases and/or fluctuates.

Accordingly, in order to solve the above problem, a multilayer impedance element has been proposed in which voids are formed between magnetic ceramic layers and internal conductor layers by a treatment to immerse a fired magnetic ceramic element in an acidic plating solution so as to avoid the influence of stress by the internal conductor layers to the magnetic ceramic layers and to overcome the decrease and/or fluctuation of the impedance value, as disclosed in Japanese Unexamined Patent Application Publication No. 2004-22798.

However, in the multilayer impedance element disclosed in Japanese Unexamined Patent Application Publication No. 2004-22798, since discontinuous voids are formed between the magnetic ceramic layers and the internal conductor layers by immersing the magnetic ceramic element in the plating solution so as to enable the plating solution to permeate the inside of the magnetic ceramic element through portions of the internal conductor layers that are exposed on the surfaces of the magnetic ceramic element, the internal conductor layers and the voids are formed between the magnetic ceramic layers, and the internal conductor layers are thinned. By such a practice, the ratio of the internal conductor layers present between the magnetic ceramic layers inevitably decreases.

Hence, a problem may arise in that a product having a low direct current resistance is difficult. In particular, in the case of a compact product, such as a product having dimensions of 1.0 mm, 0.5 mm, and 0.5 mm or a product having dimensions of 0.6 mm, 0.3 mm, and 0.3 mm, the thickness of each magnetic ceramic layer must be decreased, and internal conductor layers each having a large thickness are difficult to form while the internal conductor layers and the voids are both provided between the magnetic ceramic layers. Accordingly, the direct current resistance is not only decreased but also fracture of the internal conductor layers caused by a surge or the like is liable to occur, and as a result, a problem in that sufficient reliability cannot be ensured may occur.

SUMMARY OF THE INVENTION

The present invention has been conceived to solve the problems described above, and an object of the present invention is to provide a highly reliable multilayer coil component without forming voids, as in the past, between magnetic ceramic layers and internal conductor layers which form a multilayer coil component, wherein internal stresses disadvantageously generated between the magnetic ceramic layers and the internal conductor layers due to the differences in firing shrinkage behavior and coefficient of thermal expansion therebetween can be reduced. It is another object of the present invention to provide a highly reliable multilayer coil component wherein the direct current resistance is low, and wherein the fracture of the internal conductors caused by a surge or the like is not likely to occur. In addition, the multilayer coil component of the present invention described above has a self-alignment property and excellent mountability.

In order to achieve the above object, in an embodiment of the present invention, a multilayer coil component of the present invention includes: a magnetic ceramic element formed by firing a ceramic laminate which is formed by laminating magnetic ceramic layers to each other and which includes coil-forming internal conductors primarily composed of Ag. The internal conductors are interlayer-connected to each other to form a spiral coil. No voids are present at interfaces between the internal conductors and a magnetic ceramic located therearound. The internal conductors are separated from the magnetic ceramic at the interfaces therebetween. The multilayer coil component of the present invention further includes a magnetic ceramic of the magnetic ceramic element forming a central region located between the uppermost external layer and the lowermost external layer of the internal conductors.

The magnetic ceramic of the magnetic ceramic element has a region which extends from a side surface of the magnetic ceramic element to the internal conductors and which has a pore area ratio of 6% to 20%. The multilayer coil component of the present invention further includes at least one of a first external layer region, located between an upper surface of the uppermost external layer of the internal conductors in the magnetic ceramic element and an upper surface thereof, and a second external layer region, located between a lower surface of the lowermost external layer of the internal conductors in the magnetic ceramic element and a lower surface thereof, has a pore area ratio of less than 5%.

In the multilayer coil component of the present invention, the first and the second external layer regions each preferably have a pore area ratio of less than 5%.

The pore area ratio of a magnetic ceramic forming a side gap portion, which is a region located between side portions of the internal conductors and the side surface of the magnetic ceramic element, may be set in the range of 6% to 20%.

A whole magnetic ceramic forming the central region may be a magnetic ceramic having a pore area ratio of 6% to 20%.

In addition, in the case in which two end portions of the spiral coil are extended to respective two side surfaces of the magnetic ceramic element facing each other, when the magnetic ceramic element is viewed from one of the side surfaces thereof to which one of the end portions of the spiral coil is extended, a thickness dimension (i.e., a lamination direction dimension) is preferably made different from a width dimension which is a dimension in the direction perpendicular to the lamination direction.

In addition, of the first and the second external layer regions, the thickness of one external layer region disposed at a mounting surface side facing a mounting substrate on which the multilayer coil component is to be mounted is preferably set larger than that of the other external layer region, and the pore area ratio of the external layer region at a mounting surface side is preferably set to less than 5%.

In the multilayer coil component of the present invention, since a central region in the lamination direction sandwiched by external layer regions has a region which extends from a side surface of a magnetic ceramic element to the internal conductors and which has a pore area ratio of 6% to 20%, and at least one of a first external layer region and a second external layer region located so as to sandwich the central region is formed dense to have a pore area ratio of less than 5%, when mounting is performed so that a dense external layer region is disposed at a mounting surface side facing a mounting substrate, in a mounting step by solder reflow or the like, a flux in a solder paste can be prevented from being absorbed in the magnetic ceramic element. Hence, a multilayer coil component having superior mountability can be provided in which the solder fusibility and the self-alignment property are superior in a soldering step.

In addition, since the central region has the region which extends from the side surface of the magnetic ceramic element to the internal conductors and which has a pore area ratio of 6% to 20%, when the magnetic ceramic element is immersed in an acidic solution so that the acidic solution is allowed to reach interfaces between the internal conductors and a magnetic ceramic, bonds therebetween can be efficiently fractured at the interfaces.

Since no voids are allowed to be present at the interfaces between the internal conductors and the magnetic ceramic located therearound, and the internal conductors and the magnetic ceramic are separated from each other at the interfaces, stress is suppressed or prevented from being applied to the magnetic ceramic located around the internal conductors. Accordingly, a high performance and highly reliable multilayer coil component can be provided in which variation in characteristics is small, the resistance is low, and fracture of the internal conductors caused by a surge or the like can be suppressed or prevented.

In addition, when the first and the second external layer regions are each a dense external layer region having a pore area ratio of less than 5%, mounting can be performed without considering the direction of the front or the rear surface, and hence the present invention can be more effectively used.

In addition, in the present invention, although the magnetic ceramic forming a central region may partly include a region which extends from the side surface of the magnetic ceramic element to the internal conductors and which has a pore area ratio of 6% to 20%, when the pore area ratio of a magnetic ceramic forming a side gap portion is set in the range of 6% to 20%, an acidic solution can be more reliably allowed to reach the interfaces between the internal conductors and the magnetic ceramic.

In addition, when combination between magnetic ceramic green sheets and a conductive paste for forming internal conductors, which are used in a process for manufacturing a general multilayer coil component, is appropriately taken into consideration, a side gap portion having a pore area ratio of 6% to 20% can be efficiently and advantageously realized.

In addition, as described above, in the present invention, although the magnetic ceramic forming a central region may partly include a region which extends from the side surface of the magnetic ceramic element to the internal conductors and which has a pore area ratio of 6% to 20%, a whole magnet forming the central region may be a magnetic ceramic having a pore area ratio of 6% to 20%.

In this case, since the central region is formed by laminating magnetic ceramic green sheets which are formed to have a pore area ratio of 6% to 20% by firing, without using a particularly complicated manufacturing process, a central region having a whole porous structure can be easily, reliably and advantageously formed.

In addition, when the thickness dimension and the width dimension of the magnetic ceramic element are made different from each other, without particularly providing a direction discrimination mark, surfaces (e.g., upper and lower surfaces) at which the external layer regions of the magnetic ceramic element are disposed can be discriminated from surfaces (e.g., side surfaces) at which no external layer region is formed, and hence the multilayer coil component can be reliably mounted when the surface at which the external layer region is disposed to face a mounting substrate.

In addition, of the first and the second external layer regions, when the thickness of one external layer region disposed at a mounting surface side facing a mounting substrate on which the multilayer coil component is to be mounted is set larger than that of the other external layer region, and when the pore area ratio of the external layer region at a mounting surface side is set to less than 5%, while the height of the whole multilayer coil component is reduced, a flux in a solder paste can be reliably suppressed or prevented from being absorbed in the magnetic ceramic element.

DESCRIPTION OF THE PREFERRED EMBODIMENTS

Hereinafter, with reference to examples of the present invention, the features of the present invention will be described in more detail.

Example 1

Figure 1:
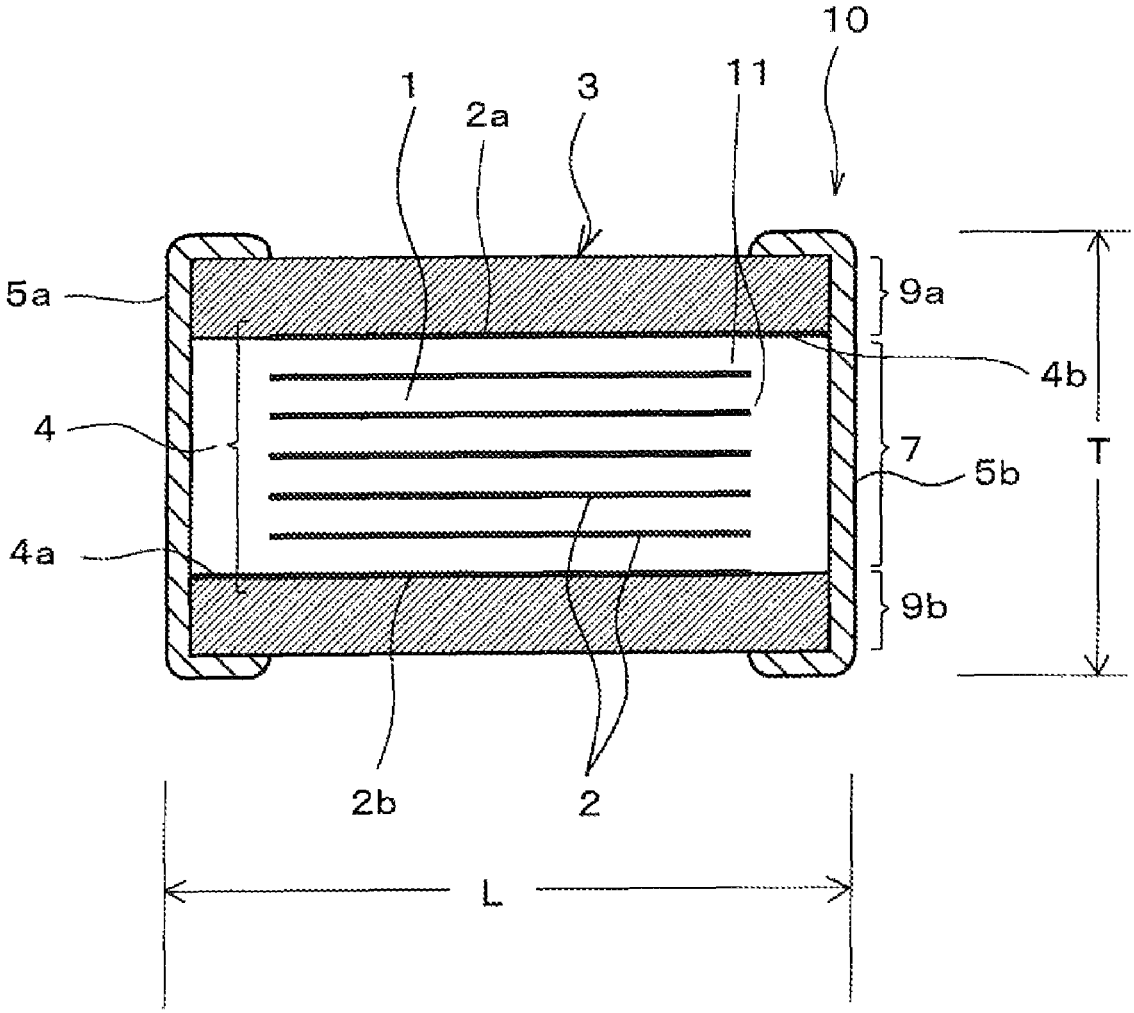
FIG. 1 is a front cross-sectional view showing the structure of a multilayer coil component according to Example 1 of the present invention.
Figure 2:
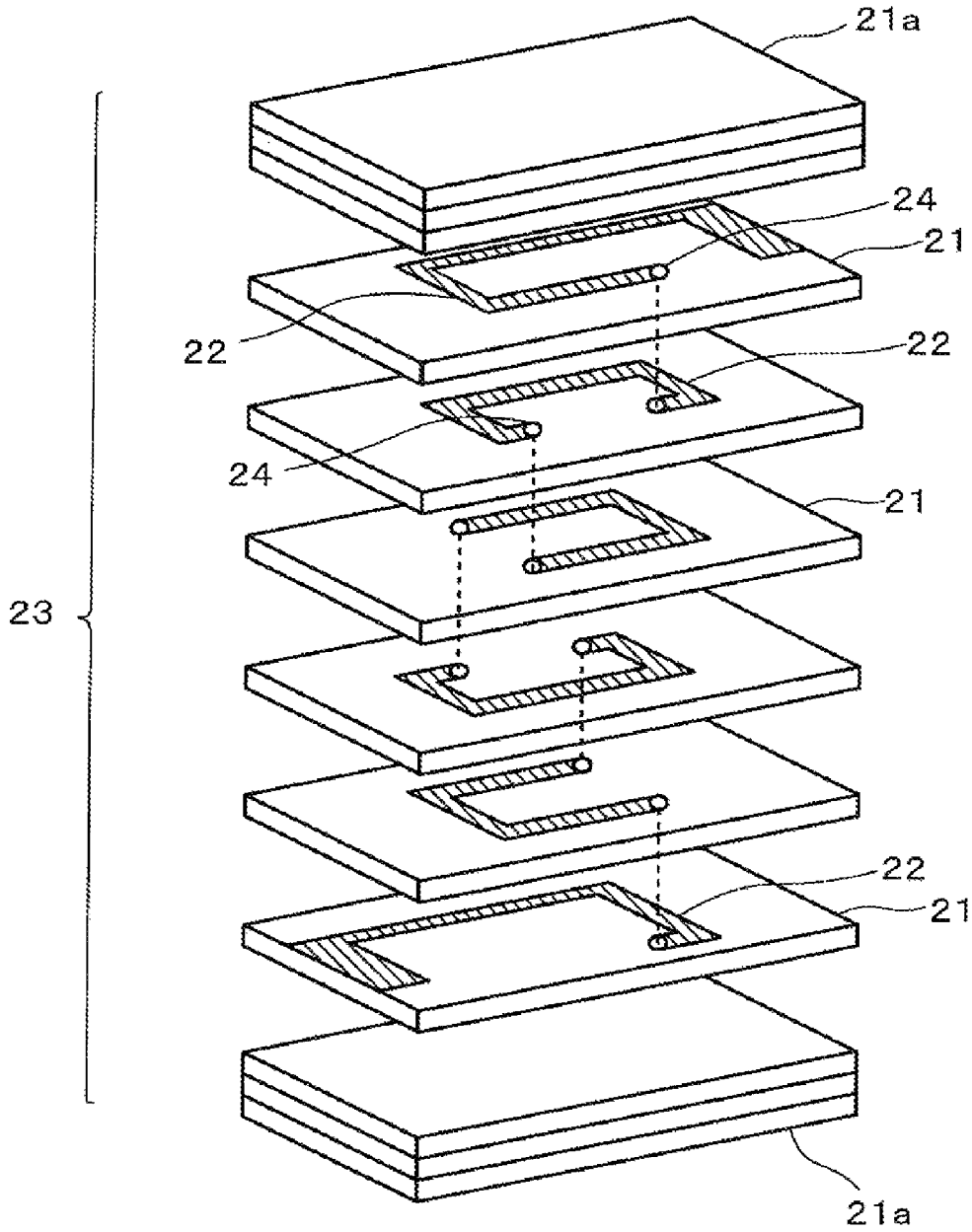
FIG. 2 is an exploded perspective view showing a method for manufacturing the multilayer coil component according to Example 1 of the present invention.
Figure 3:
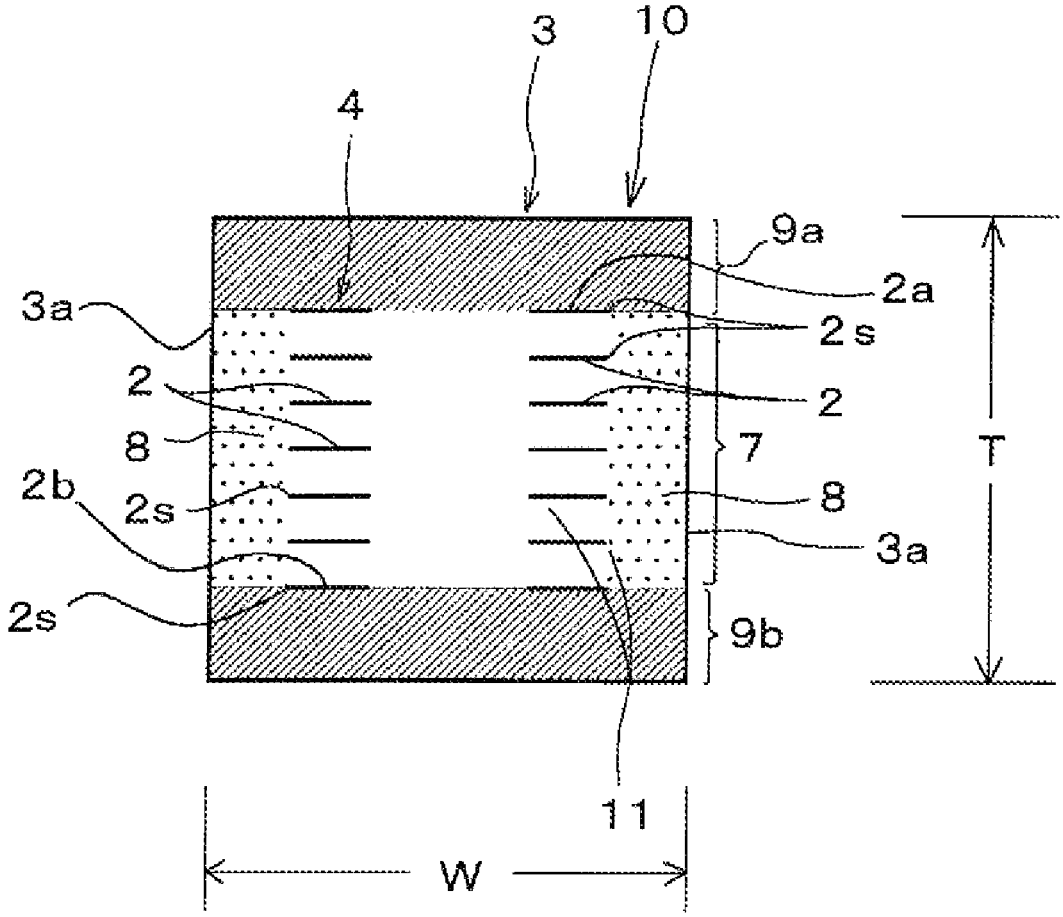
FIG. 3 is a side cross-sectional view showing the structure of the multilayer coil component according to Example 1 of the present invention.

FIG. 1 is a cross-sectional view showing the structure of a multilayer coil component (multilayer impedance element in Example 1) according to one example (Example 1) of the present invention, FIG. 2 is an exploded perspective view showing a method for manufacturing the above component, and FIG. 3 is a side cross-sectional view showing the structure of the multilayer coil component shown in FIG. 1.

This multilayer coil component 10 is manufactured through a step of firing a laminate in which coil-forming internal conductors 2 primarily composed of Ag and magnetic ceramic layers 1 are laminated to each other, and a magnetic ceramic element 3 includes a spiral coil 4 therein.

In addition, a pair of external electrodes 5*a* and 5*b* is provided on two end portions of the magnetic ceramic element 3 so as to be electrically connected to two end portions 4*a* and 4*b* of the spiral coil 4, respectively.

In addition, in this multilayer coil component 10, no voids are present at interfaces between the internal conductors 2 and a magnetic ceramic 11 located therearound, and the internal conductors 2 and the magnetic ceramic 11 located therearound are in approximately close contact with each other. However, it is configured such that the internal conductors 2 are separated from the magnetic ceramic 11 at the interfaces therebetween.

In addition, in a central region 7 of the magnetic ceramic element 3 which is located between an uppermost-external internal conductor 2*a* and a lowermost-external internal conductor 2*b*, a side gap portion 8 which is a region at least between side portions 2*s* of the internal conductors 2 and a side surface 3*a* of the magnetic ceramic element 3 is formed of a porous magnetic ceramic having a pore area ratio of 6% to 20% (in the multilayer coil component of Example 1, the pore area ratio is 18%).

In addition, in this multilayer coil component 10, a first external layer region 9*a* located between an upper surface of the uppermost-external internal conductor 2*a* in the magnetic ceramic element 3 and an upper surface thereof and a second external layer region 9*b* located between a lower surface of the lowermost-external internal conductor 2*b* in the magnetic ceramic element 3 and a lower surface thereof are each formed of a dense magnetic ceramic having a pore area ratio of less than 5% (in the multilayer coil component 10 of Example 1, the pore area ratio is 4%).

In addition, although no voids are present at the interfaces between the internal conductors 2 and the magnetic ceramic 11 located therearound, and the internal conductors 2 and the magnetic ceramic 11 located therearound are in approximately close contact with each other, it is configured such that the internal conductors 2 are separated from the magnetic ceramic 11 at the interfaces therebetween.

Incidentally, as for the dimensions of the multilayer coil component 10 of this example, a longitudinal dimension L is 1.0 mm, a thickness dimension T is 0.5 mm, and a width dimension W is 0.5 mm.

In addition, in this multilayer coil component 10, since the internal conductors 2 are separated from the magnetic ceramic 11 at the interfaces therebetween while no voids are present at the interfaces between the internal conductors 2 and the magnetic ceramic 11, without thinning the internal conductors, the multilayer coil component 10 can be obtained in which stress applied to the magnetic ceramic 11 located around the internal conductors is reduced. Hence, a highly reliable multilayer coil component can be obtained in which the variation in characteristics is small, the direct current resistance can be reduced, and fracture of the internal conductors caused by a surge or the like is not likely to occur.

Next, a method for manufacturing this multilayer coil component 10 will be described.

(1) A magnetic raw material was prepared in such a way that $Fe_2O_3$, ZnO, NiO, and CuO were weighed at a ratio of 48.0 mole percent, 29.5 mole percent, 14.5 mole percent, and 8.0 mole percent, and wet mixing was performed using a ball mill for 48 hours. Subsequently, a slurry obtained by the wet mixing was dried by a spray dryer and was calcined at 700° C. for 2 hours.

The calcined material thus obtained was wet-pulverized by a ball mill for 16 hours, and a predetermined amount of a binder was mixed after the pulverization was finished, so that a ceramic slurry was obtained.

Next, this ceramic slurry was formed into sheets, so that central-region ceramic green sheets each having a thickness of 25 μm were formed.

In addition, the same calcined material as described above was wet-pulverized by a ball mill for 32 hours, and a predetermined amount of a binder was mixed after the pulverization was finished, so that a ceramic slurry was obtained.

Next, this ceramic slurry was formed into sheets, so that external layer-region ceramic green sheets each having a thickness of 25 μm were formed.

(2) After via holes were formed in the central-region ceramic green sheets at predetermined positions, a conductive paste for forming internal conductors was printed on the surfaces of the ceramic green sheets, so that coil patterns (i.e., internal conductor patterns) each having a thickness of 16 μm were formed.

As the conductive paste, a conductive paste containing 85 percent by weight of Ag was used in which a Ag powder containing 0.1 percent by weight or less of impurity elements, a varnish, and a solvent were blended together.

(3) Subsequently, as schematically shown in FIG. 2, after central-region ceramic green sheets 21 on which internal conductor patterns (coil patterns) 22 were formed were laminated and pressure-bonded to each other, and external layer-region ceramic green sheets 21*a* on which no coil patterns were formed were further laminated on an upper and a lower surface of the above laminate, pressure bonding was performed at 1,000 kgf/cm$^2$, so that a laminate (unfired magnetic ceramic element) 23 was obtained. In this case, a method for laminating the ceramic green sheets is not particularly limited.

This unfired magnetic ceramic element 23 includes therein a laminate type spiral coil which is formed of the internal conductor patterns (coil patterns) 22 connected by via holes 24. In addition, the number of turns of the coil was set to 7.5.

(4) Subsequently, after a pressure-bonded block was cut into a predetermined size, and debinding was performed, sintering was performed at 860° C., so that a magnetic ceramic element including the spiral coil therein was obtained.

In this step, it is confirmed that the pore area ratio of the side gap portion between the side portions 2*s* of the internal conductors 2 and the side surface 3*a* of the magnetic ceramic element 3 is 18%.

In addition, it is confirmed that the first external layer region 9*a* located between the upper surface of the uppermost-external internal conductor 2*a* in the magnetic ceramic element 3 and the upper surface thereof and the second external layer region 9*b* located between the lower surface of the lowermost-external internal conductor 2*b* in the magnetic ceramic element 3 and the lower surface thereof are each formed of a dense magnetic ceramic layer having a pore area ratio of 4%.

(5) Subsequently, after a conductive paste for forming external electrodes was applied to the two end portions of the magnetic ceramic element (sintered element) 3 including the spiral coil 4 therein and was dried, firing was performed at 750° C., so that the external electrodes 5*a* and 5*b* (see FIG. 1) were formed.

Incidentally, as the conductive paste for forming external electrodes, a conductive paste was used in which a Ag powder having an average particle diameter of 0.8 μm, a B—Si—K-based glass frit having superior plating resistance and an average particle diameter of 1.5 μm, a varnish, and a solvent were blended together. In addition, the external electrodes formed by firing this conductive paste were dense and hence were not likely to be eroded by a plating solution in the following plating step.

(6) Subsequently, the external electrodes 5*a* and 5*b* thus formed were processed by Ni plating and Sn plating, so that two-layer structure plating films each having a Ni plating film layer as a lower layer and a Sn plating film layer as an upper layer were formed. Accordingly, the multilayer coil component (multilayer impedance element) 10 having the structure as shown in FIGS. 1 and 3 is obtained.

In addition, in the above plating step, as a Ni plating solution, an acidic solution having a pH of 4 was used which contained nickel sulfate, nickel chloride, and boric acid at a ratio of approximately 300 g/L, approximately 50 g/L, and approximately 35 g/L.

In addition, as a Sn plating solution, an acidic solution having a pH of 5 was used which contained tin sulfate and ammonium sulfate at a ratio of approximately 70 g/L and approximately 100 g/L.

Figure 4:
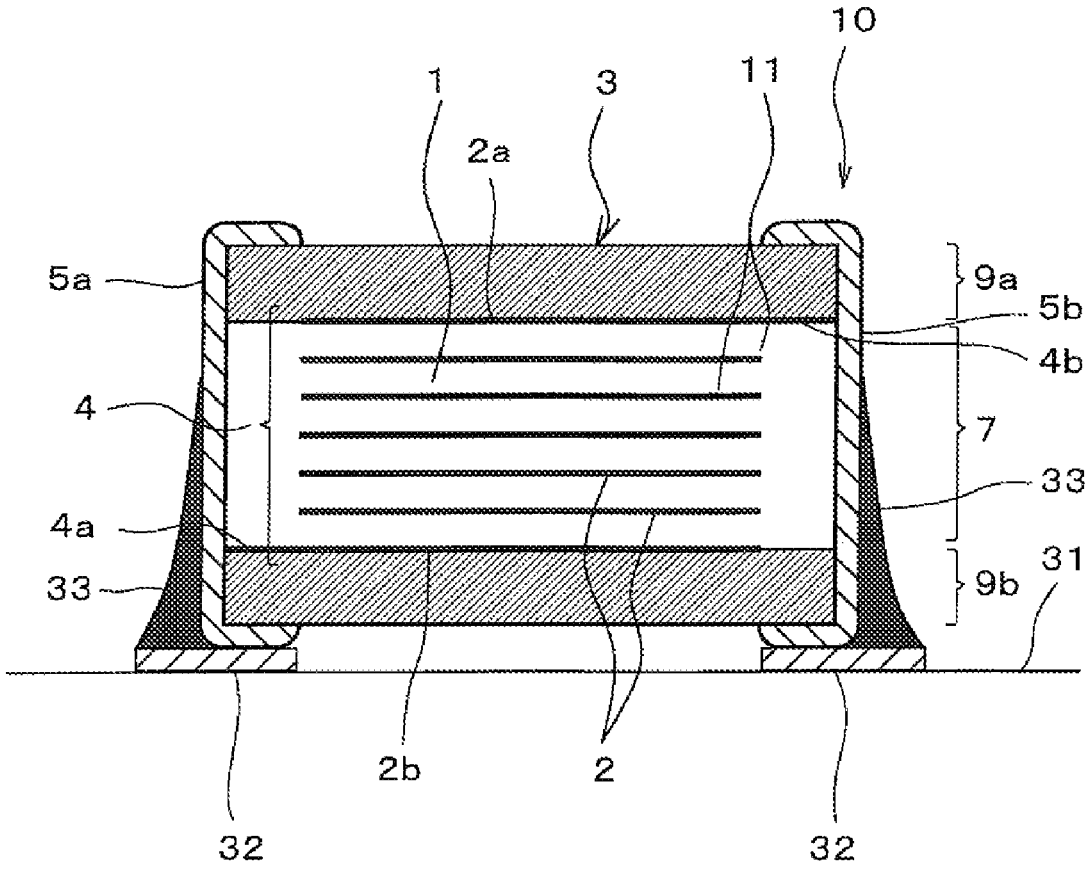
FIG. 4 is a view showing the state in which the multilayer coil component according to Example 1 of the present invention is mounted on a mounting substrate.

Subsequently, the multilayer coil component formed as described above was mounted on a mounting substrate by a reflow soldering method. FIG. 4 shows the state in which the multilayer coil component is mounted on the mounting substrate.

As shown in FIG. 4, when the multilayer coil component 10 of Example 1 is mounted on lands 32 on a mounting substrate 31 with solder 33 interposed therebetween, and since the pore area ratio of the external layer regions 9*a* and 9*b* forming the magnetic ceramic element 3 is as low as less than 5%, a flux in a solder paste used in the reflow soldering step is not absorbed in the external layer region (the lower side external layer region 9*a* in the state shown in FIG. 4), and the solder is reliably melted. Hence, it is confirmed that the multilayer coil component 10 is reliably mounted on a predetermined position. That is, the self-alignment property is superior.

In addition, in the step of performing Ni plating and Sn plating on the external electrodes, since an acidic plating solution enters the interfaces between the internal conductors and the magnetic ceramic through the side gap portions of the magnetic ceramic element, and the bonds between the internal conductors and the magnetic ceramic are fractured at the interfaces therebetween, stress applied to the magnetic ceramic located around the internal conductors is reduced; hence, it is confirmed that a multilayer coil component having high characteristics, such as the impedance, and a small variation thereof can be obtained.

In addition, after the internal conductor was exposed by treating the end surface of the magnetic ceramic element forming the multilayer coil component of Example 1 using focused ion beam processing (FIB processing), the processed surface was observed by a scanning electron microscope (SEM), and it was confirmed that no voids were formed at the interfaces between the internal conductors and the magnetic ceramic.

Example 2

Figure 5:
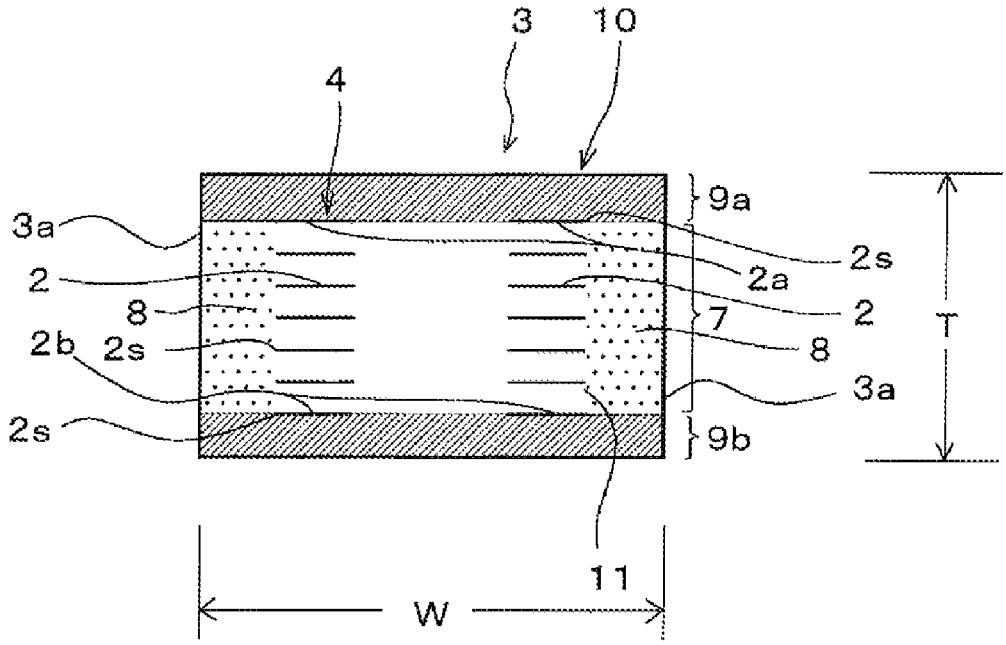
FIG. 5 is a side cross-sectional view showing the structure of a multilayer coil component according to another example (Example 2) of the present invention.

In addition, FIG. 5 is a side cross-sectional view showing a multilayer coil component according to another example (Example 2) of the present invention.

As shown in FIG. 5, in this multilayer coil component 10, the thickness dimension T which is the lamination direction dimension is made different from the width dimension W which is the dimension in the direction perpendicular to the lamination direction (in Example 1, the thickness dimension T is equal to the width dimension W) so as to be able to discriminate the upper and the lower surfaces of the magnetic ceramic element 3 from the side surfaces thereof. The thickness dimension T is made smaller than the width dimension W so as to reduce the height of the component. The thickness dimension T is set, for example, to less than 0.5 mm and, in particular, is preferably set to 0.3 mm or the like. The remaining structure is similar to that of the multilayer coil component of Example 1.

In addition, this multilayer coil component can be manufactured by the same method as that of Example 1 except that the number of the external layer-region ceramic green sheets provided on the upper and the lower sides are only decreased.

As in the case of this multilayer coil component, when the thickness dimension T and the width dimension W are made different from each other, the upper and the lower surfaces of the magnetic ceramic element can be discriminated from the side surfaces thereof, and without using a direction discrimination mark, the multilayer coil component can be easily, reliably, and advantageously mounted when the dense external layer region is disposed to face a mounting substrate.

Example 3

Figure 6:
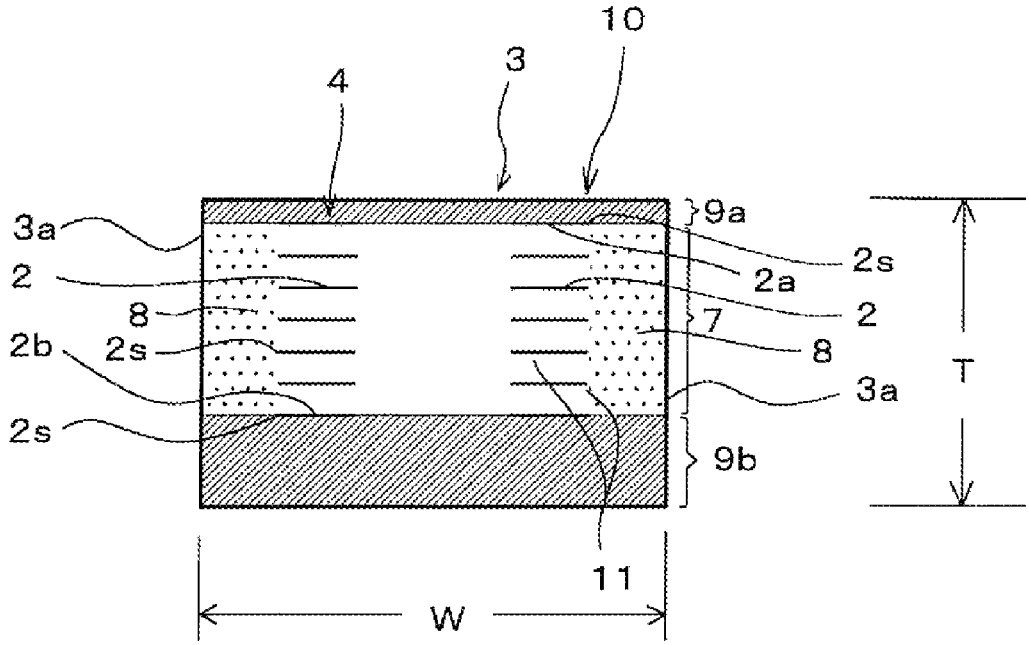
FIG. 6 is a side cross-sectional view showing the structure of a multilayer coil component according to another example (Example 3) of the present invention.

In addition, FIG. 6 is a side cross-sectional view showing a multilayer coil component according to another example (Example 3) of the present invention.

In this multilayer coil component 10, the thickness of the lower side external layer region 9*b* is formed larger than that of the upper side external layer region 9*a*, and the magnetic ceramic element 3 is formed so that the thickness dimension T is smaller than the width dimension W. In addition, the remaining structure is similar to that of Example 1.

This multilayer coil component can be manufactured in a manner similar to that of Example 1 except that the number of the external layer-region ceramic green sheets for the upper side is made different from that of the external layer-region ceramic green sheets for the lower side.

In this multilayer coil component 10 of Example 3, since the thickness dimension T is smaller than the width dimension W, the height of the component can be reduced, and from the shape thereof, the upper and the lower surfaces of the magnetic ceramic element 3 can be discriminated from the side surfaces thereof.

Furthermore, in this multilayer coil component 10, since the lower side external layer region 9*b* is formed to have a large thickness, and the upper side external layer region 9*a* is formed to have a small thickness, when the external layer region 9*b* having a large thickness is mounted so as to face a mounting substrate, absorption of a flux contained in a solder paste can be reliably suppressed or prevented.

However, in the case of this multilayer coil component, a mark for discriminating the upper surface from the lower surface (surface disposed to face a mounting substrate) must be provided.

In addition, when the lamination is performed while the upper and the lower surfaces are reliably discriminated from each other by the mark, the lower side external layer region which faces a mounting substrate in mounting may be formed of a dense magnetic ceramic, and the upper side external layer region may not be always formed of a dense magnetic ceramic having a pore area ratio of 5% or less.

Example 4

Figure 7:
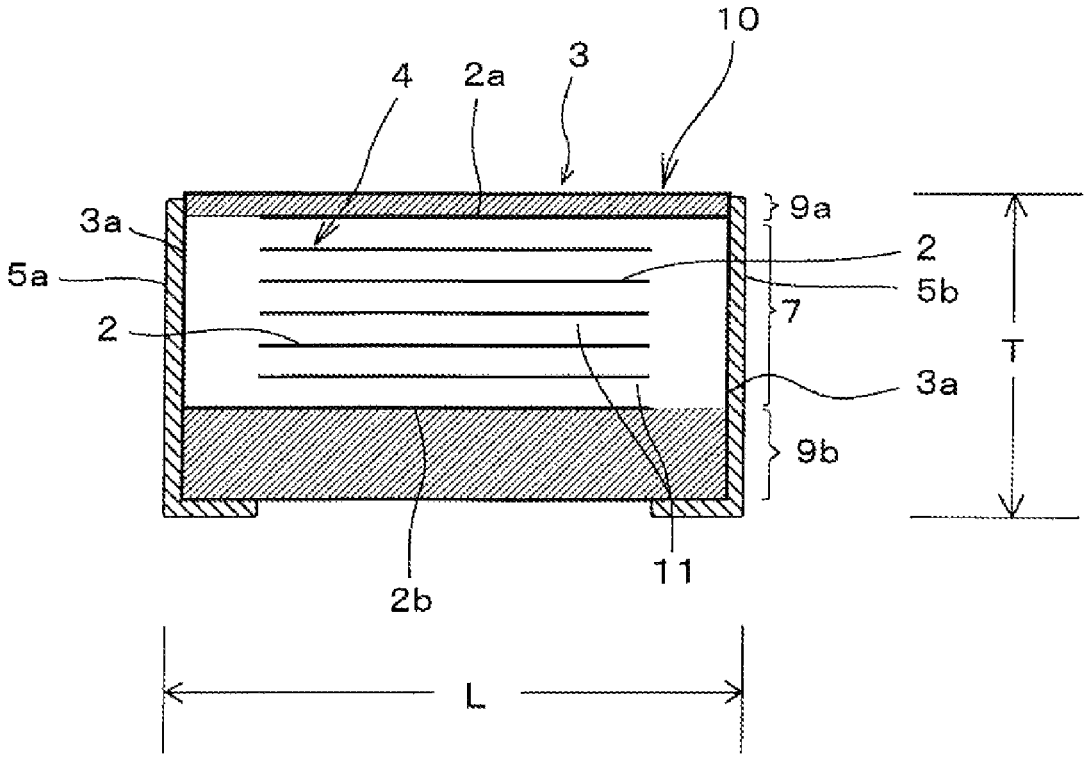
FIG. 7 is a front cross-sectional view showing the structure of a multilayer coil component according to another example (Example 4) of the present invention.

In addition, FIG. 7 is a front cross-sectional view showing a multilayer coil component according to another example (Example 4) of the present invention.

This multilayer coil component 10 is different from the multilayer coil components of Examples 1 to 3 in such a way that the external electrodes 5*a* and 5*b* are each formed to extend from one end surface of the magnetic ceramic element 3 to the lower surface side thereof and not to the upper surface side. However, the remaining structure is similar to that of multilayer coil component of Example 3.

In this multilayer coil component 10 of Example 4, since being formed to extend only to the lower surface side of the magnetic ceramic element 3, the external electrodes 5*a* and 5*b* also each function as a direction discrimination mark. As a result, without particularly providing a direction discrimination mark, the upper and the lower surfaces of the magnetic ceramic element 3 can be discriminated from the side surfaces thereof.

In addition, in the case of the structure of Example 4, since the upper surface, the lower surface, and the side surfaces of the magnetic ceramic element can be discriminated from each other by the external electrodes which extend from the end surfaces of the magnetic ceramic element to the lower surface side thereof, for example. Even when the thickness dimension is equal to the width dimension, and the thickness of the upper external region is different from that of the lower external region, a unique advantage can be obtained in which without particularly providing a direction discrimination mark, the upper surface, the lower surface, and the side surfaces of the magnetic ceramic element are discriminated from each other when mounting is performed. Accordingly, the multilayer coil component can be mounted when the external region having a larger thickness is disposed to face a mounting substrate.

Furthermore, in this multilayer coil component, since the external electrodes are formed to extend only to the lower surface side and are not formed at the upper surface side, only by this structure, the height of the component can be reduced thereby, and problems caused by external electrodes which interfere with other wires and the like when extending to the upper surface side can be prevented.

In addition to that described above, advantages similar to those of the multilayer coil component of Example 3 can also be obtained.

In addition, also in this structure of Example 4, the upper side external layer region may not be always formed of a dense magnetic ceramic layer having a pore area ratio of 5% or less.

Comparative Example

For the comparison purpose, as the central-region ceramic green sheets, the same ceramic green sheets as the external layer-region ceramic green sheets used in Example 1 (formed into a dense magnetic ceramic having a pore area ratio of 4% by firing) were used, and as the external layer-region ceramic green sheets, the same ceramic green sheets as described above were used, so that a multilayer coil component (Comparative Example 1) was formed.

Furthermore, as the external layer-region ceramic green sheets, the same ceramic green sheets as the central-region ceramic green sheets used in Example 1 (formed into a porous magnetic ceramic having a pore area ratio of 18% by firing) were used, and as the central-region ceramic green sheets, the same ceramic green sheets as described above were used, so that a multilayer coil component (Comparative Example 2) was formed.

Evaluation of Characteristics

For the multilayer coil components of Examples 1 to 4 and Comparative Examples 1 and 2 formed as described above, the impedance was measured by the following method, and also the pore area ratios of the external layer region and the side gap portion were measured. Furthermore, each multilayer coil component was mounted on a mounting substrate by a reflow soldering method, and the self-alignment property in this step was evaluated.

(a) Measurement of Impedance

Measurement of the impedance was performed on 30 samples using an impedance analyzer (HP4291A, HP16196 manufactured by Hewlett-Packard Co.), and the average value was then obtained (n=30 pcs.).

(b) Measurement of Pore Area Ratio

After a cross-sectional surface (hereinafter referred to as "W-T surface") defined by the width direction and the thickness direction of the magnetic ceramic element was processed by mirror polishing and was then treated by focused ion beam processing (FIB processing), the surface thus processed was observed by a scanning electron microscope (SEM), so that the pore area ratio of the magnetic ceramic was measured.

In particular, the pore area ratio was measured using an image processing software "WINROOF" (manufactured by Mitani Corporation). The detailed measurement method is as follows.

FIB apparatus: FIB200TEM manufactured by FEI

FE-SEM (scanning electron microscope): JSM-7500FA manufactured by JEOL Ltd.

WINROOF (image processing software): Ver. 5.6 manufactured by Mitani Corporation Focused Ion Beam Processing (FIB Processing)

FIB processing was performed at an incident angle of 5° with respect to a polished surface of a sample which was mirror-polished by the above method.

Observation by Scanning Electron Microscope (SEM)

SEM observation was performed under the following conditions.

Acceleration voltage: 15 kV

Sample inclination: 0°

Signal: Secondary electrons

Coating: Pt

Magnification: 5,000 times

Calculation of Pore Area Ratio

The pore area ratio was obtained by the following method.

a) The measurement range is determined. When the range is too small, errors caused by measurement points are generated.

(In this example, the range was set to 22.85 μm by 9.44 μm.)

b) When it is difficult to discriminate between the magnetic ceramic and pores, the brightness and the contrast are adjusted. c) The binary image processing is performed so as to extract only pores. When "color extraction" by the image processing software "WINROOF" is not perfect, manual operation is additionally performed.

d) When images other than pores are extracted, the images other than pores are eliminated.

e) The total area, the count, the pore area ratio, and the area of the measurement range are measured by "Measurement of Total Area/Count" of the image processing software.

The pore area ratio of the present invention is a value measured as described above.

(c) Self-Alignment Property

After the multilayer coil component was mounted at a position displaced from the center of a mounting coordinate by 150 μm in the longitudinal direction or the width direction of the multilayer coil component so as to intentionally generate displacement (mounting displacement) of a mounting position of the multilayer coil component, and reflowing was performed in the atmosphere, when the displacement of the mounting position of the multilayer coil component from the target position was 50 μm or more, the self-alignment property was evaluated as No Good (x). When the above displacement was less than 50 μm, the self-alignment property was evaluated as Good (○).

Table 1 shows the pore area ratio of the side gap portion, the pore area ratio of the external layer region, the impedance (|Z|) value, and the evaluation result of the self-alignment property, which were measured as described above.

TABLE 1

| Sample | Pore area ratio of side gap portion (%) | Pore area ratio of external layer region (%) | Impedance (\|Z\|) · 100 MHz (Ω) | Self-alignment property |
|---|---|---|---|---|
| Example 1 | 18 | 4 | 605 | ○ |
| Example 2 | 18 | 4 | 590 | ○ |
| Example 3 | 18 | 4 | 587 | ○ |
| Example 4 | 18 | 4 | 595 | ○ |
| Comparative Example 1 | 4 | 4 | 350 | ○ |
| Comparative Example 2 | 4 | 18 | 610 | x |

As shown in Table 1, in the case of the multilayer coil components of Examples 1 to 4 of the present invention, a high impedance value is obtained. The reason for this is that since the pore area ratio of the side gap portion in the central region is as high as 18%, and the bonds between the internal conductors and the magnetic ceramic are fractured at the interfaces therebetween when a plating solution enters the inside of the magnetic ceramic element in a plating step performed on the external electrodes, stress applied to the magnetic ceramic located around the internal conductors is reduced.

In addition, in the case of the multilayer coil components of Examples 1 to 4 of the present invention, it was confirmed that the self-alignment property was superior. The reason for this is that since the external layer region is dense so as to have a pore area ratio of 4%, a flux in a solder paste used in a mounting step is not absorbed in the external layer region, and the solder fusibility is preferably maintained, so that a superior self-alignment property can be ensured.

On the other hand, in the case in which a multilayer coil component (Comparative Example 1) is formed using as the central-region ceramic green sheets, the same ceramic green sheets as the external layer-region ceramic green sheets (formed by sintering into a dense magnetic ceramic having a pore area ratio of 4%), although the self-alignment property is superior, the impedance value decreases.

The reason for this is that since the pore area ratio of the side gap portion is as low as 4%, a plating solution cannot enter the inside of the magnetic ceramic element through the side gap portion in a plating step performed on the external electrodes, the bonds between the internal conductors and the magnetic ceramic located therearound are not fractured, and stress is applied to the magnetic ceramic, so that the characteristics are degraded.

In addition, in the case in which a multilayer coil component (Comparative Example 2) is formed using as the external layer-region ceramic green sheets, the same ceramic green sheets as the central-region ceramic green sheets (formed by sintering into a porous magnetic ceramic having a pore area ratio of 18%), since in a plating step performed on the external electrodes, a plating solution enters the inside, and the bonds between the internal conductors and the magnetic ceramic are fractured at the interfaces therebetween, although the impedance value is high, the self-alignment property is degraded. The reason for this is that since the pore area ratio of the external layer region is as high as 18%, a flux in a solder paste is absorbed in the external layer region in a mounting step, and the solder fusibility is degraded, so that the self-alignment property is degraded.

In addition, in each example described above, as the central-region ceramic green sheets and the external layer-region ceramic green sheets, ceramic green sheets formed under different conditions (in the above examples, the difference was such that the pulverizing time of the calcined material by a ball mill was 16 hours for the central-region ceramic green sheets and was 32 hours for the external layer-region ceramic green sheets) were used so that the pore area ratio of the side gap portion had a predetermined value or more. However, when the sintering shrinkage rate of the magnetic ceramic is set larger than that of the internal conductor, the side gap portion can be formed to have a pore area ratio of 6% to 20% due to the difference in sintering shrinkage rate between the above two.

In the case described above, when the sintering shrinkage rate of the internal conductor is set to 0% to 15% based on the assumption that the shrinkage rate of the magnetic ceramic is larger than that of the internal conductor, the pore area ratio of the side gap portion can be set in the range of 6% to 20%.

In addition, after the internal conductor patterns are formed on the central-region ceramic green sheets, when a ceramic paste which is to be formed by sintering into a magnetic ceramic having a pore area ratio of 6% to 20% is applied to the areas around the internal conductor patterns, and the ceramic green sheets thus processed are laminated to each other, the side gap portion can be formed to have a pore area ratio of 6% to 20%.

In addition, in each example described above, although the case in which manufacturing was performed by a so-called sheet lamination method which included a step of laminating ceramic green sheets was described by way of example, manufacturing may also be performed by a so-called sequential printing method in which after a magnetic ceramic slurry and a conductive paste for forming internal conductors are prepared, printing is performed using the above slurry and paste to form a laminate having the structure as described in each of the above examples.

Furthermore, manufacturing may also be performed by a so-called sequential transfer method in which a laminate having the structure as shown in each of the above examples is formed. In this method, for example, after a ceramic layer formed by printing (applying) a ceramic slurry on a carrier film is transferred onto a table, an electrode paste layer formed by printing (applying) an electrode paste on a carrier film is transferred onto the transferred ceramic layer, and the above steps are repeatedly performed.

In addition, in each example described above, an acidic solution was used as a plating solution for plating the external electrodes, and the multilayer coil component was immersed in this plating solution to fracture the bonds between the internal conductors and the magnetic ceramic located therearound at the interfaces therebetween. However, for example, at the stage before the plating step is performed, the multilayer coil component may be immersed in a $NiCl_2$ solution (pH of 3.8 to 5.4). In addition, another acidic solution may also used.

In addition, in each example described above, although the case in which the multilayer coil components were formed one by one (one-by-one production case) was described by way of example, when mass production is performed, manufacturing may be performed by a so-called multi-production method in which, for example, after many coil conductor patterns are printed on surfaces of mother ceramic green sheets, and the mother ceramic green sheets are laminated and pressure-bonded to each other to form an unfired laminate block, many multilayer coil components are simultaneously manufactured through a step in which the laminate block is cut in accordance with the arrangement of the coil conductor patterns to obtain laminates for the multilayer coil components.

The multilayer coil component of the present invention may also be formed by a still another method, and a particular manufacturing method is not specifically limited by the examples discussed herein.

In addition, in each example described above, although the case in which the multilayer coil component was a multilayer impedance element was described by way of example, the present invention may also be applied to various multilayer coil components, such as a multilayer inductor and a multilayer transformer.

In addition, the present invention may also be applied to a multilayer coil component having an open magnetic circuit structure which partly contains a non-magnetic ceramic.

Furthermore, the other points of the present invention are also not limited to the examples described above, and the value of the pore area ratio of the magnetic ceramic element forming the external layer region, the thickness of the internal conductor, the thickness of the magnetic ceramic layer, the dimension of the product, the firing conditions of the laminate (magnetic ceramic element), and the like may be variously changed and modified within the scope of the present invention.

As described above, according to the present invention, even when at least part of the magnetic ceramic element is formed of a porous magnetic ceramic so that a plating solution or the like is allowed to enter the inside, a multilayer coil component can be obtained in which the solder fusibility and the self-alignment property are prevented from being degraded due to adsorption of a flux in a soldering step.

Hence, the present invention may be widely applied to various multilayer coil components, such as a multilayer impedance element and a multilayer inductor, each having the structure in which a coil is provided in a magnetic ceramic.

While preferred embodiments of the invention have been described above, it is to be understood that variations and modifications will be apparent to those skilled in the art without departing from the scope and spirit of the invention. The scope of the invention, therefore, is to be determined solely by the following claims.

What is claimed is:

1. A multilayer coil component comprising:

a magnetic ceramic element formed by firing a ceramic laminate which is formed by laminating magnetic ceramic layers to each other, the magnetic ceramic element including coil-forming internal conductors primarily composed of Ag, the internal conductors being interlayer-connected to each other to form a spiral coil, wherein no voids are present at interfaces between the internal conductors and a magnetic ceramic of the magnetic ceramic element located therearound, the internal conductors being separated from the magnetic ceramic at the interfaces therebetween, a magnetic ceramic of the magnetic ceramic element forming a central region, located between an uppermost external layer and a lowermost external layer of the internal conductors, has a region which extends from a side surface of the magnetic ceramic element to the internal conductors, the region extending from the side surface including a pore area ratio of 6% to 20%, and at least one of a first external layer region, located between an upper surface of the uppermost external layer of the internal conductors in the magnetic ceramic element and an upper surface of the first external layer region, and a second external layer region, located between a lower surface of the lowermost external layer of the internal conductors in the magnetic ceramic element and a lower surface of the second external layer region, has a pore area ratio of less than 5%.

2. The multilayer coil component according to claim 1, wherein the first and the second external layer regions each have a pore area ratio of less than 5%.

3. The multilayer coil component according to claim 1, wherein the pore area ratio of a magnetic ceramic forming a side gap portion, which is a region between side portions of the internal conductors and the side surface of the magnetic ceramic element, is in the range of 6% to 20%.

4. The multilayer coil component according to claim 1, wherein a whole magnetic ceramic forming the central region is a magnetic ceramic having a pore area ratio of 6% to 20%.

5. The multilayer coil component according to claim 1, wherein in the case in which two end portions of the spiral coil are extended to respective two side surfaces of the magnetic ceramic element facing each other, when the magnetic ceramic element is viewed from one of the side surfaces thereof to which one of the end portions of the spiral coil is extended, a thickness dimension, which is a lamination direction dimension, is made different from a width dimension which is a dimension in the direction perpendicular to the lamination direction.

6. The multilayer coil component according to claim 1, wherein, of the first and the second external layer regions, the thickness of one external layer region, disposed at a mounting surface side facing a mounting substrate on which the multilayer coil component is to be mounted, is larger than that of the other external layer region, and the pore area ratio of the external layer region at a mounting surface side is less than 5%.

7. The multilayer coil component according to claim 2, wherein the pore area ratio of a magnetic ceramic forming a side gap portion, which is a region between side portions of the internal conductors and the side surface of the magnetic ceramic element, is in the range of 6% to 20%.

8. The multilayer coil component according to claim 2, wherein a whole magnetic ceramic forming the central region is a magnetic ceramic having a pore area ratio of 6% to 20%.

9. The multilayer coil component according to claim 7, wherein in the case in which two end portions of the spiral coil are extended to respective two side surfaces of the magnetic ceramic element facing each other, when the magnetic ceramic element is viewed from one of the side surfaces thereof to which one of the end portions of the spiral coil is extended, a thickness dimension, which is a lamination direction dimension, is made different from a width dimension which is a dimension in the direction perpendicular to the lamination direction.

10. The multilayer coil component according to claim 8, wherein in the case in which two end portions of the spiral coil are extended to respective two side surfaces of the magnetic ceramic element facing each other, when the magnetic ceramic element is viewed from one of the side surfaces thereof to which one of the end portions of the spiral coil is extended, a thickness dimension, which is a lamination direction dimension, is made different from a width dimension which is a dimension in the direction perpendicular to the lamination direction.

11. The multilayer coil component according to claim 3, wherein in the case in which two end portions of the spiral coil are extended to respective two side surfaces of the magnetic ceramic element facing each other, when the magnetic ceramic element is viewed from one of the side surfaces thereof to which one of the end portions of the spiral coil is extended, a thickness dimension, which is a lamination direction dimension, is made different from a width dimension which is a dimension in the direction perpendicular to the lamination direction.

12. The multilayer coil component according to claim 4, wherein in the case in which two end portions of the spiral coil are extended to respective two side surfaces of the magnetic ceramic element facing each other, when the magnetic ceramic element is viewed from one of the side surfaces thereof to which one of the end portions of the spiral coil is extended, a thickness dimension, which is a lamination direction dimension, is made different from a width dimension which is a dimension in the direction perpendicular to the lamination direction.

13. The multilayer coil component according to claim 9, wherein, of the first and the second external layer regions, the thickness of one external layer region, disposed at a mounting surface side facing a mounting substrate on which the multilayer coil component is to be mounted, is larger than that of the other external layer region, and the pore area ratio of the external layer region at a mounting surface side is less than 5%.

14. The multilayer coil component according to claim 2, wherein, of the first and the second external layer regions, the thickness of one external layer region, disposed at a mounting surface side facing a mounting substrate on which the multilayer coil component is to be mounted, is larger than that of the other external layer region, and the pore area ratio of the external layer region at a mounting surface side is less than 5%.

15. The multilayer coil component according to claim 3, wherein, of the first and the second external layer regions, the thickness of one external layer region, disposed at a mounting surface side facing a mounting substrate on which the multilayer coil component is to be mounted, is larger than that of the other external layer region, and the pore area ratio of the external layer region at a mounting surface side is less than 5%.

16. The multilayer coil component according to claim 4, wherein, of the first and the second external layer regions, the thickness of one external layer region, disposed at a mounting surface side facing a mounting substrate on which the multilayer coil component is to be mounted, is larger than that of the other external layer region, and the pore area ratio of the external layer region at a mounting surface side is less than 5%.

17. The multilayer coil component according to claim 5, wherein, of the first and the second external layer regions, the thickness of one external layer region, disposed at a mounting surface side facing a mounting substrate on which the multilayer coil component is to be mounted, is larger than that of the other external layer region, and the pore area ratio of the external layer region at a mounting surface side is less than 5%.

* * * * *